US006868688B2

(12) United States Patent
Narehood

(10) Patent No.: US 6,868,688 B2
(45) Date of Patent: Mar. 22, 2005

(54) ACCESS TUNNEL FOR LOW TEMPERATURE FREEZING SYSTEMS

(75) Inventor: Abraham C. Narehood, Leicester, NC (US)

(73) Assignee: Kendro Laboratory Products, Inc., Asheville, NC (US)

( * ) Notice: Subject to any disclaimer, the term of this patent is extended or adjusted under 35 U.S.C. 154(b) by 0 days.

(21) Appl. No.: 10/347,431

(22) Filed: Jan. 21, 2003

(65) Prior Publication Data

US 2003/0136141 A1 Jul. 24, 2003

Related U.S. Application Data

(60) Provisional application No. 60/349,234, filed on Jan. 18, 2002.

(51) Int. Cl.[7] ..... F25D 21/06; F25D 11/00; A47B 81/00

(52) U.S. Cl. ..... 62/275; 62/440; 312/405; 312/407.1

(58) Field of Search ..... 62/275, 272, 440, 62/441, 447; 312/401, 405, 407.1

(56) References Cited

U.S. PATENT DOCUMENTS 2,584,886 A * 2/1952 Laguzzi ..... 312/405
3,462,885 A * 8/1969 Miller ..... 49/475.1
4,080,764 A * 3/1978 Stowik et al. ..... 52/205
4,142,092 A * 2/1979 Abrams ..... 219/218
4,330,310 A * 5/1982 Tate et al. ..... 62/275
4,588,235 A * 5/1986 Barroero ..... 312/138.1
5,209,082 A * 5/1993 Ha ..... 62/265
5,476,318 A * 12/1995 Yingst et al. ..... 312/405
5,600,966 A * 2/1997 Valence et al. ..... 62/440
5,605,047 A * 2/1997 Park et al. ..... 62/3.6
5,632,543 A * 5/1997 McGrath et al. ..... 312/406
5,966,963 A * 10/1999 Kovalaske ..... 62/441
6,254,503 B1 * 7/2001 Chiba et al. ..... 474/8
6,408,636 B1 * 6/2002 Backes et al. ..... 62/275
2002/0021062 A1 * 2/2002 Hodges ..... 312/401

* cited by examiner

*Primary Examiner*—William C. Doerrler
(74) *Attorney, Agent, or Firm*—Baker & Hostetler LLP; Marc W. Butler

(57) ABSTRACT

A method and apparatus for accessing low temperature refrigeration systems is provided. In one embodiment, an access tunnel is provided and a heater, an access door, a vacuum insulation panel, a thermal break, a sealing gasket that mates with a sealing surface together or in part(s) helps to prevent condensation from forming on the exterior of the freezer.

18 Claims, 3 Drawing Sheets

ACCESS TUNNEL FOR LOW TEMPERATURE FREEZING SYSTEMS

PRIORITY

This application claims benefit of U.S. provisional patent application Ser. No. 60/349,234, filed on Jan. 18, 2002, which is incorporated herein by reference.

FIELD OF THE INVENTION

The present invention relates generally to accessing samples stored in a refrigeration unit. More particularly, the present invention relates to the integration of laboratory automation into low temperature freezers requiring a means of accessing samples stored therein.

BACKGROUND OF THE INVENTION

Commercial refrigerators and freezers, such as ones employed in laboratories, generally comprise a cabinet or compartment having a rectangular opening in one of the vertical walls. A door mounting frame is inserted within this opening, and a plurality of insulated glass doors are hingedly mounted within the frame. Because the insulated glass doors usually comprise a plurality of glass panes, they are relatively heavy and require a sturdy and rugged frame for supporting their weight and for withstanding abusive repeated opening and closing that occurs in laboratory environments.

The normal operating temperature for commercial refrigeration units is between about 34° F. and 36° F., while commercial freezer units may be operated as low as −30° F. or more. If preventative measures are not taken, portions of the metal frame will cool to temperatures below the dew point temperature of the ambient air, resulting in the accumulation of condensation and/or frost on the surface of the frame. Such condensation build up in commercial refrigeration and freezer door assemblies is undesirable since it can create a puddle below the door, which is a safety hazard. It further graphically shows the waste of energy.

To prevent condensation and frost formation on the metal door's mounting frame, it has been the practice to include electrical resistance heating wires within the frame for maintaining the portions of the frame exposed to warmer ambient air at a temperature above the dew point of the ambient air. Such electrical heating means not only adds to the manufacturing cost of the frame, but increases the operating cost of the refrigerator or freezer unit.

While considerable efforts have been directed toward combating condensation build up and minimizing heating requirements, such as by insulating the frame, or interrupting the heat conductive path through the frame by means of thermal barriers or breaks, these efforts have not been entirely successful and often complicate the manufacture of the frame. For example, one approach has been to create a thermal break in the door mounting frame by forming an aluminum extrusion with a channel shaped opening, pouring hot melted plastic material into the opening which solidifies in an intimate contact with the channel, and thereafter severing the channel to separate the frame into independent sections separated by the solid plastic. Such a procedure is highly time consuming, and hence, significantly adds to the manufacturing cost of the product. Proposals to change the material of the frame so that it is less expensive or less heat conductive generally have not been adopted, usually by reason of strength considerations and the desire that the frame have an attractive metal finish consistent with existing commercial freezers and refrigerators.

Notwithstanding the foregoing efforts, a particularly troublesome condensation problem has continued to occur on the metal sealing strip of the door mounting frame, which serves as an attraction and sealing plate for a magnet carrying gasket mounted on the doors. Since the metal sealing plate usually is larger than the magnetic gasket so as to ensure contact by the gasket upon closure of the door, a portion of the sealing plate usually extends beyond the gasket so as to be exposed to ambient air for prolonged periods even when the door is closed. Because of the high heat conductivity of the metal sealing plate, the portion of the sealing plate exposed to the ambient air often cools below the dew point temperature of the ambient air, again resulting in the undesired formation of condensation on such exposed portion.

Given the present problems with condensation and access to freezer interiors, the present invention utilizes an access tunnel that can be made at least partially from a thermal break extending from the interior of a freezer unit to the unit's exterior. This configuration reduces condensation build up and minimizes heating requirements of the sealing surface located at the sealed access door to the tunnel on the exterior of the freezer unit.

The present invention overcomes the prior art problems found with larger freezer access doors and frames by utilizing a less expensive, small access tunnel to retrieve freezer samples or contents. This access tunnel could be used in automation systems needing speedy access to freezer samples while minimizing ambient temperature introduction into the freezer's interior.

SUMMARY OF THE INVENTION

In one embodiment of the invention, a tunnel assembly for a cooling apparatus having a plurality of insulated walls, the tunnel assembly can include a tunnel defined at least partially by a thermal break that can be formed in one of the insulated walls, the tunnel allowing access to an interior portion of the cooling apparatus, a heater can be positioned near an outside surface of one of the insulated walls and can be near an opening end of the tunnel, and an access door that can cover an exterior opening of the tunnel and can be movably mounted to provide access to the tunnel. The tunnel assembly can further include at least one sealing gasket that can be coupled to the access door to seal the access door with the tunnel, a sealing surface for sealing with the at least one sealing gasket, and a vacuum insulation panel positioned within one of the insulated walls. The thermal break may define the entire tunnel. The thermal break and access door may be made from a low thermal conductive material such as a polymer, a plastic, an acrylonitrile butadiene styrene (ABS), a polycarbonate, a polyethylene, a Teflon®, a polypropylene, other low thermal conductive material and a combination thereof. The sealing surface can be made from a polymer, a plastic, an acrylonitrile butadiene styrene (ABS), a polycarbonate, a polyethylene, a Teflon®, a polypropylene, other low thermal conductive material and a combination thereof. The access door can be moveable in at least one direction to allow access to the tunnel. The heater's temperature may be set above the dew point temperature.

In another embodiment, a method of accessing an interior of a cooling apparatus having a plurality of insulated walls is provided and can include providing an access door that covers an access tunnel formed in one of the insulated walls, moving the access door to access the access tunnel, and preventing condensation from forming on the exterior of one of the insulated walls with the access door and a thermal break made from a low thermal conductive material, and a heater that heats an area surrounding the access tunnel. Preventing condensation can be further accomplished by a sealing gasket coupled to the access door that can mate with a sealing surface on the exterior surface of one of the insulated walls, the sealing surface can be made from the low thermal conductive material. The low thermal conductive material can be selected from a group consisting of a polymer, a plastic, an acrylonitrile butadiene styrene (ABS), a polycarbonate, a polyethylene, a Teflon®, a polypropylene, other low thermal conductive material and a combination thereof. Moving the access door can be in the direction, such as left, right, up, down, diagonally, other direction that allows access to the access tunnel and a combination thereof.

In still another embodiment, an access tunnel system for a cooling system having a plurality of insulated walls can include a means for accessing an interior of the cooling system defined at least partially by a means for reducing thermal conductivity and formed in one of the insulated walls of the cooling system, a means for heating located near an outside surface of one of the insulated walls and near an open end of the means for accessing the interior, a means for covering the open end of the means for accessing and having a means for sealing thereon that mates with a sealing surface on the outside surface of one of the insulated walls, and a means for insulating positioned within the one insulated wall to prevent heat from entering the interior of the cooling apparatus. The means for reducing a thermal conductivity can define the entire means for accessing an interior. The means for reducing a thermal conductivity, means for covering, means for insulating, and the sealing surface can be made from a low thermal conductive material, such as a polymer, a plastic, an acrylonitrile butadiene styrene (ABS), a polycarbonate, a polyethylene, a Teflon, a polypropylene, other low thermal conductive material and a combination thereof. The means for heating can be set at a temperature above the dew point of environment surrounding the cooling system. The means for covering can be movable in at least one direction to allow access to the means for accessing. The direction of movement can be left, right, up, down, diagonally, other directions and a combination thereof. The means for sealing can be made from silicon. The means for insulating can be positioned on each side of the means for accessing. The means for accessing can be at least as wide as the operator or the robot's hand.

In still a further embodiment, an access tunnel having a plurality of insulated walls is provided and can include a tunnel defined by a thermal break extending from an interior surface of one insulated wall to an exterior surface of said one insulated wall, a heater mounted on said exterior surface and proximal to an exterior opening of said tunnel, an insulated access door mounted to cover said exterior opening of said tunnel, the insulated access door having at least one sealing gasket mounted thereon, a sealing surface provided on said exterior surface to sealingly mate with the sealing gasket, and a vacuum insulated panel positioned within said one insulated wall.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DESCRIPTION OF THE INVENTION

Figure 1:
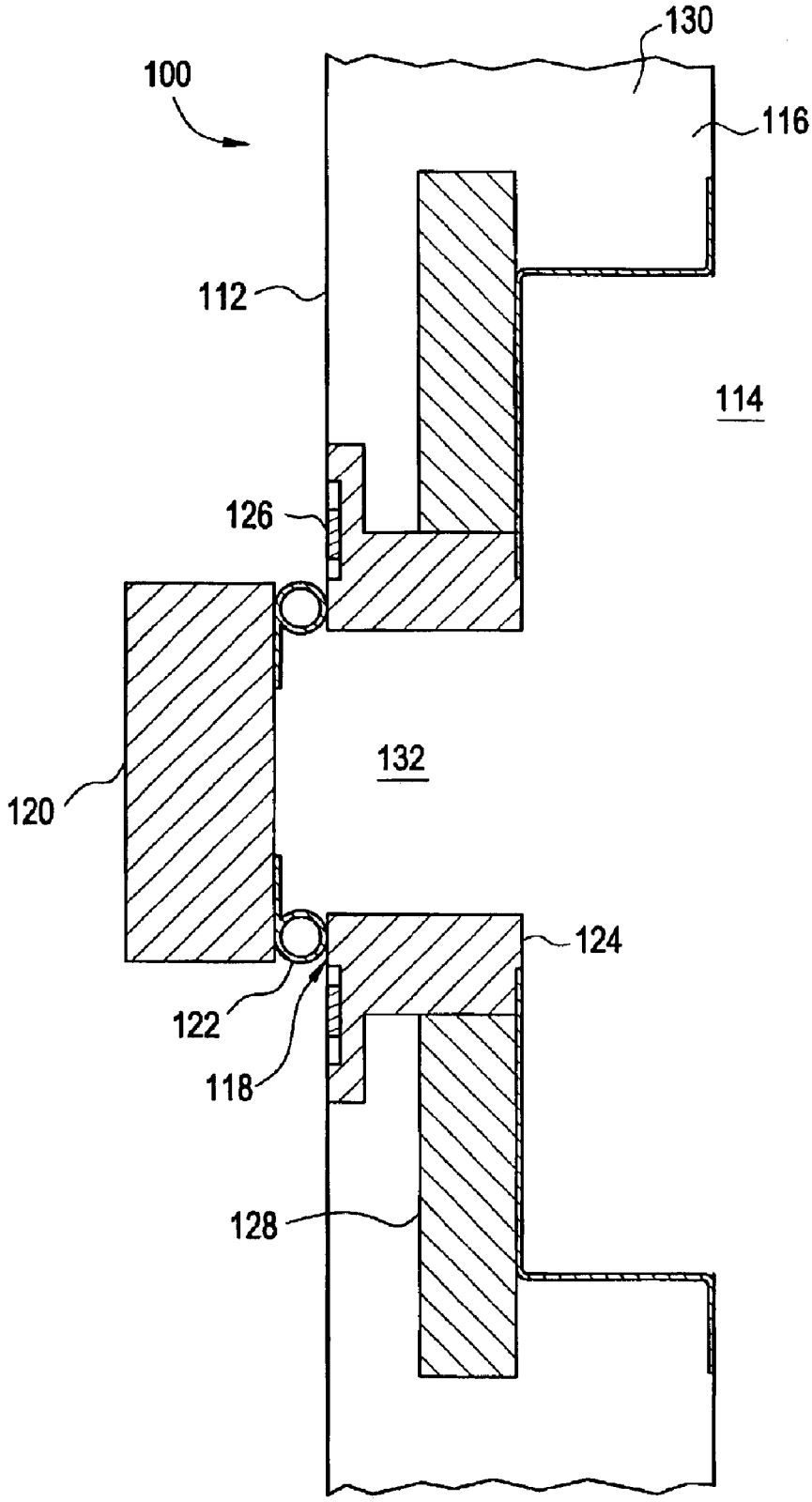
FIG. 1 is a cross-sectional view of one preferred embodiment access tunnel assembly of the present invention.

FIG. 1 is a cross-sectional view of one preferred embodiment access tunnel assembly of the present invention. As depicted in FIG. 1, a preferred embodiment of the invention provides an access tunnel assembly 100 comprised of an access door 120, a thermal break 124, a heater 126, a sealing surface 118 mating with a sealing gasket 122, and vacuum insulated panels 128 mounted within an insulated refrigeration door 130. The access tunnel assembly 100 provides a means of accessing an internal portion of the freezer or a freezer interior 114 portion without causing condensation or limiting the amount of condensation that can form on the outer surface of the freezer unit or the freezer exterior 112. The refrigerator door 130 is insulated with conventional insulation materials 116 to help keep the freezer interior 114 at the desired temperature.

The access door 120 is provided on the freezer exterior's surface 112. The access door 120 has sealing gaskets 122 coupled thereto and covers the exterior opening of an access tunnel 132. The access door 120 can be any shape, dimension, width, length or thickness, so long as it covers the access tunnel 132 formed within the freezer door 130. The access door 120 can be made from any material, but preferably, the door is made from a low thermal conductive material, such as a polymer, plastic, Acrylonitrile Butadiene Styrene (ABS), polycarbonate, polyethylene, Teflon®, polypropylene, other low conduction material and combination thereof. Because the material has a low thermal conductive property, it will be easier to maintain the cooler interior temperature and limit the change in temperature that can be caused by the warmer exterior temperature. The access door 120 has an inner surface that can be coupled to sealing gasket 122, which in turn is in sealing contact with the freezer exterior 112 at its sealing surface 118.

There is at least one sealing gasket 122, but there can be two, four or more sealing gaskets at each end of the access door 120. The sealing gasket 112 can be made from a material, such as a silicon or the low thermal conductive material discussed above, and surrounds the opening of the access tunnel. By surrounding the opening, the warmer air does not enter the freezer interior 114 through natural openings or cracks that can occur when the access door 120 is in the closed position. The access door 120 can be opened (shown in FIGS. 2 and 3) in various manners to access the freezer interior 114 via the access tunnel 132. The access tunnel 132 can be defined at least partially by the thermal break 124 that is formed in the freezer door 130. The access tunnel 132 is rectangular in shape, but can be any size, shape or dimension, so long as it provides access to an operator or an automation specimen pick-and-place system to retrieve stored sample bottles or to place the sample bottles in the freezer. The automation system can have a robot member portion that can pick up and place specimens in the freezer interior 114 as desired by the operator. The robot member can have means for moving the access door 120 to gain access to the freezer interior 114.

A sealing surface 118 is provided near the access tunnel to have a sealing relationship with the sealing gasket 112 and provides a surface that remains free of ice and condensation. The sealing surface 118 can be made from the low thermal conductive material, such as the polymer, plastic, Acrylonitrile Butadiene Styrene (ABS), polycarbonate, polyethylene, Teflon®, polypropylene, and other materials that can provide a sealing surface with the sealing gasket 122 and a combination thereof.

In one embodiment, the thermal break at least partially provides the tunnel, and the remainder of the tunnel is defined by the refrigerator door 130. The thermal break 125 reduces the temperature gradient that can form between the ambient temperature on the outside of the refrigerator and the temperature of the freezer interior 114. The thermal break is made from a low thermal conductivity material that makes it hard for heat to conduct from the outside to the inside of the freezer. The low thermal conductivity material can be ABS, polycarbonate, polymer, plastic, polyethylene, Teflon®, polypropylene, other low thermal conductivity material or a combination thereof. As stated above, it is preferable that the thermal break defines the entire access tunnel 132 so that condensation better limited or prevented from forming on the freezer exterior 112.

The freezer door 130 contains at least one, but can have two or more vacuum insulation panels 116 that are on each side of the access tunnel 132. The vacuum insulation panel 116 is better than conventional urethane or foam insulation because it has a higher thermal resistance. Additionally, the vacuum insulation panel 116 has high value of insulation to thickness as compared to conventional insulation. In other words, for a given size or thickness of an insulator, the panel 116 can insulate more than conventional insulation, such as urethane. The vacuum insulation panel 116 can be made from the low thermal conductivity material such as a polymer, plastic, Acrylonitrile Butadiene Styrene (ABS), polycarbonate, polyethylene, Teflon®, polypropylene, other low conduction material and combination thereof.

A heater 126 is mounted near the sealing surface 118 and is used to eliminate condensation and to prevent ice build up on the sealing surface. The heater 126 can be a conventional heater or a resistive heater. A resistive heater contains resistive materials, which heats up as current flows through it. The heater 126 surrounds the perimeter of the access tunnel 132 and is constructed and designed to raise the temperature around the access door 120 and the sealing surface 118 above the temperature that condensation will form on that area. Because the temperature will be above the dew point, the area around the access door and the sealing surface are prevented from freezing because no condensation will form.

In operation, the user with a retrieval means, such as his hands or the robot arm portion (with a retrieval means such as a claw, a hand, etc.) of the automation system can move the access door 120 by sliding it to the left, right, diagonally (facing the freezer door 130), lifting the access door or other means of moving the access door 120 so that the user can have access to the access tunnel 132. Typically, the user or the robot member is opening the access tunnel 132 in ambient temperature or in a temperature that is greater than the interior of the freezer, thus causing condensation to form on the freezer door 130 and ultimately freezing the condensation. The freezing of the condensation can cause the access door 120 to be frozen shut, thus making it difficult to reopen for at least a small amount time. Additionally, when the frozen condensation thaws under ambient temperature, puddles of water can form on the floor causing a hazard to the user. With the use of (1) vacuum insulation panel 128, made from the thermal resistance material; (2) the thermal break 124 in the tunnel, which stops heat conduction from the exterior into the interior; (3) access door 120 made from the low thermal conductive material that prevents the outer temperature from affecting the interior temperature; (4) the sealing surface 118 made from the low thermal conductive material that prevents condensation from forming thereon by preventing heat from the exterior to affect the interior of the freezer; (5) the sealing gasket 122 to prevent heat from leaking into the freezer interior 114; and (6) the heater that keeps the sealing surface above the dew point level, in combination or in part(s), the different components will help the area surrounding the access door to remain frost-free and thus, free of condensation.

In the past, the operator had to open the entire freezer door to access the freezer interior 114, which allows heat from the exterior to enter the interior of the freezer. Because heat can enter the freezer interior, the samples will be exposed to non-ideal environmental conditions and energy will be wasted to bring the freezer interior back to the desired environmental conditions. Additionally, condensation can form due to the varying temperature that allows the outside of the freezer to be at or below the dew point. By having a tunnel as a means for the operator to retrieve samples from the freezer interior, the samples will remain closer to the desired environmental conditions.

Figure 2:
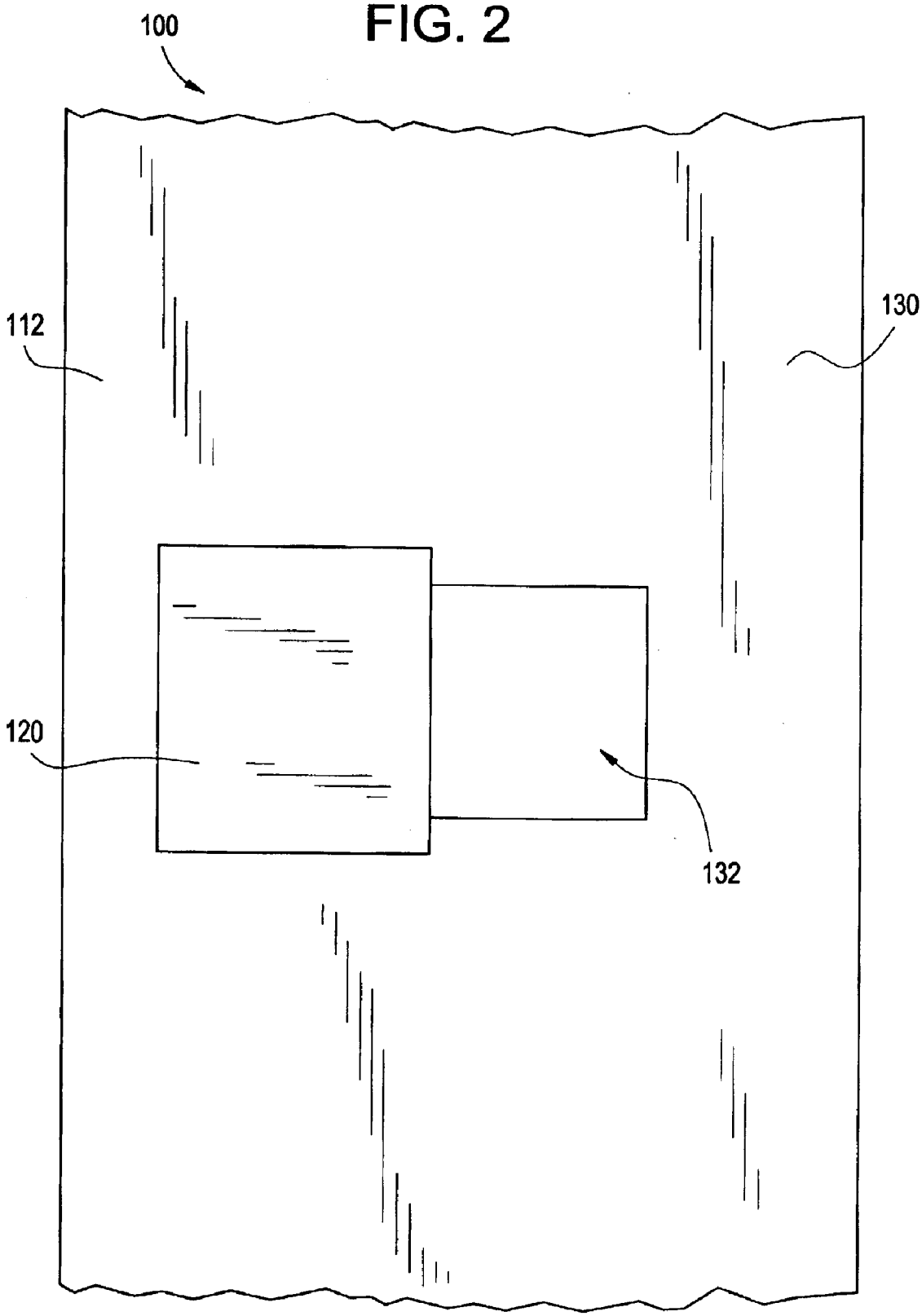
FIG. 2 illustrates a movement of the access door.

FIG. 2 illustrates a movement of the access door. The freezer exterior 112 is shown from a front view of the freezer door 130. In this figure, the operator can move the access door to the left, as shown, to the right or diagonally of the access tunnel (facing the door) to gain access to the access tunnel 132 formed in the freeze door 130. The access door with its gasket can be mounted on a railing system, hinged (FIG. 3) or other movement systems that will allow the user or the automation system to move the access door and gain access to the access tunnel.

Figure 3:
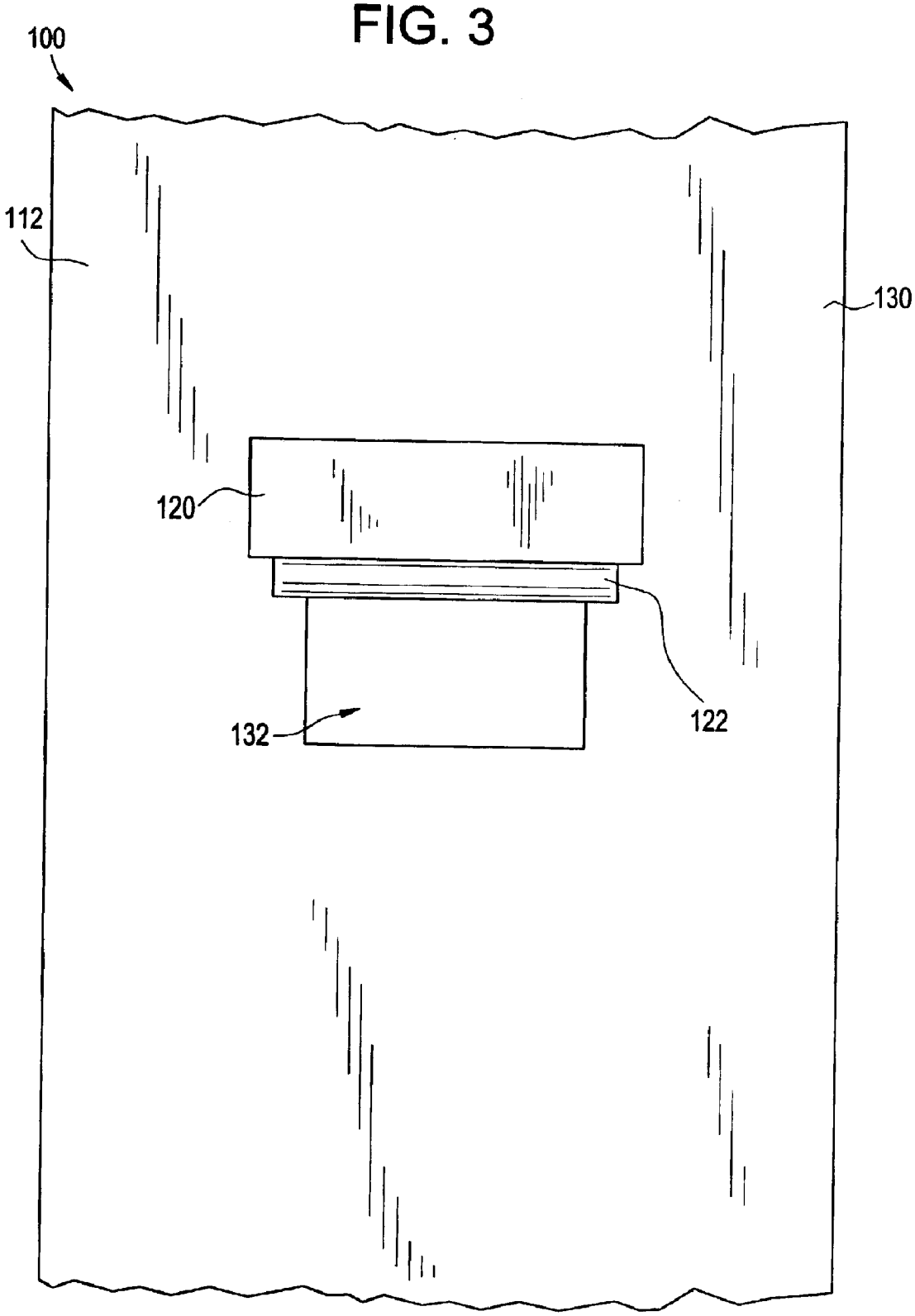
FIG. 3 illustrates another embodiment of movement the access door of the invention.

FIG. 3 illustrates another embodiment of movement the access door of the invention. Again from the front view exterior 112 of the freezer door 130, the access tunnel 132 is exposed for the operator or the automation system to have access to the freezer interior. The railing system or movement system from above can also be used to move the access door up, down, or diagonally in relation to the access tunnel so that the interior of the freezer can be accessed. A hinge or other device that allows the access door to be lifted can also be used. The gasket 122 can still be used in this arrangement and is shown in the figure.

It will be recognized by a person skilled in the art that access door can be moved in any direction so that the access tunnel is exposed and that the directions of movement of the access door are not limited to the ones discussed above. Although, a freezer is discussed herein, the access tunnel assembly 100 can be used in any cooling system, including refrigerators and other cooling devices. Additionally, the low thermal conductive material discussed herein can be any material that does not conduct heat well and should not be limited to the examples given herein.

The many features and advantages of the invention are apparent from the detailed specification, and thus, it is intended by the appended claims to cover all such features and advantages of the invention which fall within the true spirits and cope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A tunnel assembly for a cooling apparatus having a plurality of insulated walls, the tunnel assembly comprising:

a tunnel located within a door of the cooling apparatus, the tunnel defined by a thermal break that is formed in one of the insulated walls, the tunnel allowing access through said door to an interior portion of the cooling apparatus and the thermal break having an inside surface facing the interior portion of the cooling apparatus and an outside surface facing an exterior portion of the cooling apparatus;

a heater positioned on the outside surface of the thermal break and near an opening end of the tunnel, wherein the heater's temperature is set above the dew point temperature of the environment surrounding the cooling apparatus; and an access door that covers an exterior opening of the tunnel and is movably mounted to provide access to the tunnel.

2. The tunnel assembly of claim 1 further comprising:

at least one sealing gasket coupled to the access door to seal the access door with the tunnel;

a sealing surface for sealing with the at least one sealing gasket; and a vacuum insulation panel positioned within one of the insulated walls.

3. The tunnel assembly of claim 1, wherein the thermal break and access door are made from a low thermal conductive material selected from a group consisting of a polymer, a plastic, an acrylonitrile butadiene styrene (ABS), a polycarbonate, a polyethylene, a Teflon®, a polypropylene, other low thermal conductive material and a combination thereof.

4. The tunnel assembly of claim 2, wherein the sealing surface is made from a material selected from a group consisting of a polymer, a plastic, an acrylonitrile butadiene styrene (ABS), a polycarbonate, a polyethylene, a Teflon®, a polypropylene, other low thermal conductive material and a combination thereof.

5. The tunnel assembly of clalm 1, wherein the access door is moveable in at least one direction to allow access to the tunnel.

6. A method of accessing an interior of a cooling apparatus comprising:

providing a door having at least one insulated wall for the cooling apparatus;

locating an access tunnel within the door and forming the access tunnel through the at least one insulated wall of the door defined by a thermal break;

covering the access tunnel with an access door;

moving the access door to access the access tunnel; and positioning a heater on an outside surface of the thermal break and near an opening of the access tunnel; and setting a temperature of the heater above the dew point temperature of the environment surrounding the cooling apparatus to prevent condensation from forming.

7. The method of accessing of claim 6, further comprising coupling a sealing gasket to the access door to mate with a sealing surface on the exterior surface of the at least one insulated wall, the sealing surface made from a low thermal conductive material.

8. The method of accessing of claim 7, wherein the low thermal conductive material is selected from a group consisting of a polymer, a plastic, an acrylonitrile butadiene styrene (ABS), a polycarbonate, a polyethylene, a Teflon®, a polypropylene, other low thermal conductive material and a combination thereof.

9. The method of accessing of claim 6, wherein moving the access door is in the direction that is selected from a group consisting of left, right, up, down, diagonally, other direction that allows access to the access tunnel and a combination thereof.

10. An access tunnel system for a cooling system having a plurality of insulated walls, comprising:

a first means for accessing an interior of the cooling system;

a second means located within said first accessing means for accessing an interior of the cooling system defined by a means for reducing thermal conductivity that has an inside surface facing an interior portion of the cooling system and an outside surface facing an exterior portion of the cooling system and formed in one of the insulated walls of the cooling system;

a means for heating located on the outside surface of means for reducing thermal conductivity and near an open end of the second accessing means, wherein the means for heating is set at a temperature above the dew point of the environment surrounding the cooling system;

a means for covering the open end of the second accessing means and having a means for sealing thereon that mates with a sealing surface on the outside surface of one of the insulated walls; and a means for insulating positioned within the one insulated wall to prevent heat from entering the interior of the cooling apparatus.

11. The access tunnel system of claim 10, wherein the means for reducing a thermal conductivity, means for covering, means for insulating, and the sealing surface are made from a low thermal conductive material that is selected from a group consisting of a polymer, a plastic, an acrylonitrile butadiene styrene (ABS), a polycarbonate, a polyethylene, a Teflon®, a polypropylene, other low thermal conductive material and a combination thereof.

12. The access tunnel system of claim 10, wherein the means for covering is movable in at least one direction to allow access to the second accessing means.

13. The access tunnel system of claim 12, wherein the direction of movement is selected from a group consisting of left, right, up, down, diagonally, other directions and a combination thereof.

14. The access tunnel of claim 10, wherein the means for sealing is made from silicon.

15. The access tunnel of claim 10, wherein the means for insulating is positioned on each side of the second accessing means.

16. The access tunnel of claim 10, wherein the second accessing means is at least as wide as the operator hand's or the robot's hand.

17. The access tunnel of claim 10, wherein the means for sealing is made from a low thermal conductive material.

18. An access tunnel for a freezer having a plurality of insulated walls, comprising:

a tunnel located within a door of the freezer, the tunnel defined by a thermal break extending from an interior portion of one insulated wall to an exterior portion of said one insulated wall, the thermal break having an inside surface facing the interior portion and an outside surface facing the exterior portion;

a heater mounted on said outside surface of the thermal break and proximal to an exterior opening of said tunnel, wherein the heater's temperature is set above the dew point temperature of the environment surrounding the freezer;

an insulated access door mounted to cover said exterior opening of said tunnel, the insulated access door having at least one sealing gasket mounted thereon;

a sealing surface provided on said exterior surface to sealingly mate with the sealing gasket; and a vacuum insulated panel positioned within said one insulated wall.

* * * * *